United States Patent [19]

Smith et al.

[11] Patent Number: 4,941,382

[45] Date of Patent: Jul. 17, 1990

[54] SAWMILL CARRIAGE

[75] Inventors: Thomas G. Smith; Edward C. Smith, both of Reaboro, Canada

[73] Assignee: T.S. Manufacturing, Lindsay, Canada

[21] Appl. No.: 331,020

[22] Filed: Mar. 29, 1989

Related U.S. Application Data

[63] Continuation of Ser. No. 36,555, Apr. 9, 1987, abandoned.

[30] Foreign Application Priority Data

Dec. 22, 1986 [CA] Canada ..... 525958

[51] Int. Cl.[5] ..... B27B 29/08

[52] U.S. Cl. ..... 83/713; 83/719; 83/730

[58] Field of Search ..... 83/707, 712, 713, 715, 83/726, 719–725, 730, 435.1; 269/54.1, 54.2, 54.3, 63

[56] References Cited

U.S. PATENT DOCUMENTS 3,133,724 5/1964 Shashaty et al. ..... 83/719
3,492,895 2/1970 Greylock ..... 269/63

FOREIGN PATENT DOCUMENTS 50861 9/1910 Switzerland ..... 83/720

*Primary Examiner*—Hien H. Phan
*Attorney, Agent, or Firm*—Robbins & Laramie

[57] ABSTRACT

A sawmill carriage capable of reciprocating on rails towards and away from a saw is provided with more than one bunk having an upper surface capable of supporting a log, and a knee mounted on each bunk, capable of gripping a log and moving across the bunk in a direction normal to the direction of reciprocation of said carriage. An improvement comprises cylindrical slides securely attached to the bunk beneath the upper surface thereof, parallel to the direction of travel of the knee and capable of supporting same. Complimentary bushings are securely attached to the knee, and cooperate with the slides.

3 Claims, 4 Drawing Sheets

SAWMILL CARRIAGE

This is a continuation of U.S. patent application Ser. No. 36,555, filed Apr. 9, 1987, now abandoned.

The present invention relates to the field of sawmill equipment. In particular, the present invention relates to an improvement in sawmill construction, and even more particularly, to an improved sawmill carriage.

A sawmill carriage consists of a series of interconnected lateral (relative to the longitudinal direction in which a log is cut in a mill) supports called "bunks" mounted on rails for reciprocal movement up and down the rails. Each bunk is provided with a knee capable of movement across the bunk, normal to the direction in which a log is cut. The bunks are provided with large pawl-like gripping devices known as dogs. When a log is firmly gripped by the dogs of each knee on a carriage, it may be moved in two directions. That is, the carriage may be moved longitudinally to push the log into a rotating saw blade and cut off a board. Then, after a board is cut off, and the carriage retracted, the knees may be moved laterally, in unison, so that a width of log corresponding to the next board to be cut may be brought into alignment with the saw blade.

It will readily be appreciated, then, that it is important to have the knees position a log as accurately as possible on the bunks. This is so that boards of correct thickness may be produced with a minimum of after treatment (such as planing). Moreover, it is important that board thickness be consistent, from one board to the next, and throughout the length of each individual board.

Currently, and throughout the prior art known to the applicant, knees have been mounted on the bunks of sawmill carriage by means of C-clamp slides. This has led to an undesirable amount of play in the knees on the bunk. Moreover knees have traditionally been moved up and down bunks by means of motor driven chains, necessitating the maintenance of fairly complete mechanical systems which are capable of only limited accuracy.

The object of the present invention is to provide a novel means of supporting a knee on a bunk for lateral motion there across, in combination or conjunction with means for moving the knees across the bunks synchronously. The sawmill carriage of the present invention has relatively few moving parts.

In one broad aspect, the present invention relates, in a sawmill carriage capable of reciprocating on rails towards and away from a saw, and provided with more than one bunk having an upper surface capable of supporting a log, and a knee mounted on each said bunk, capable of gripping a log and moving across said bunk in a direction normal to the direction of reciprocation of said carriage, to the improvement comprising cylindrical slides securely attached to said bunk beneath said upper surface, parallel to the direction of travel of said knee and capable of supporting said knee; and complimentary bushings securely attached to said knee and cooperating with said slides.

In another broad aspect, the present invention relates, in a sawmill carriage capable of reciprocating on rails towards and away from a saw, and provided with more than one bunk having an upper surface capable of supporting a log, and a knee mounted on each said bunk, capable of gripping a log and moving across said bunk in a direction normal to the direction of reciprocation of said carriage to the improvement comprising, in combination: (i) a pair of cylindrical slides disposed beneath the upper surface of said bunks and securely attached to the ends of same; (ii) bushings on said knees slidable on said cylindrical slides (i) and capable of supporting said knees, there being a deformable seal on each end of said bushing; (iii) a hydraulically powered cylinder extending between and connected to the rearward end of each knee and the end of the associated bunk; (iv) a source of hydraulic fluid, connected to said hydraulically powered cylinder via hydraulic lines and a servo valve.

In drawings which illustrate the present invention by way of example:

Figure 1:
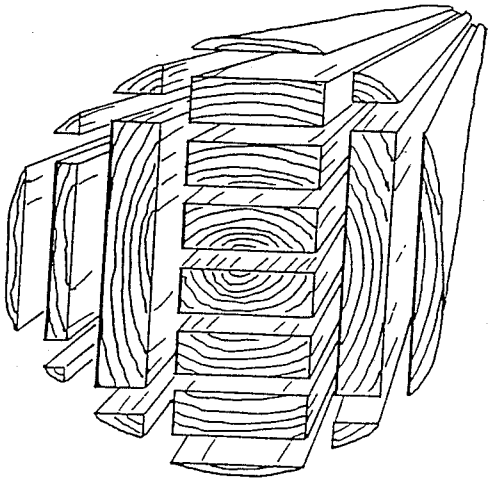
FIG. 1 is a schematic diagram of a typical cutting pattern of a log.

Referring first to FIG. 1, a schematic of a log is shown, cut into pieces. These are the cuts which must be made in a sawmill, and made accurately. It will be appreciated, from the many cuts shown in FIG. 1, that lateral positioning of a log on a carriage, which as discussed above is accomplished by the knees which move across the bunk, is very important.

Figure 2:
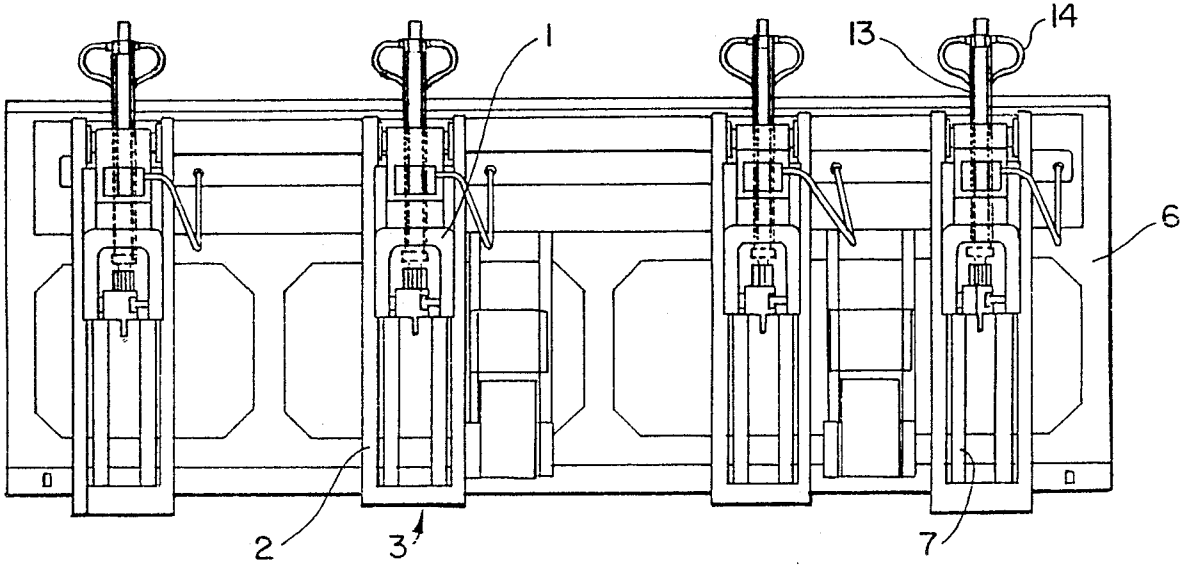
FIG. 2 is a top plan view of a sawmill embodying the slides and cylinders of the present invention.
Figure 2A:
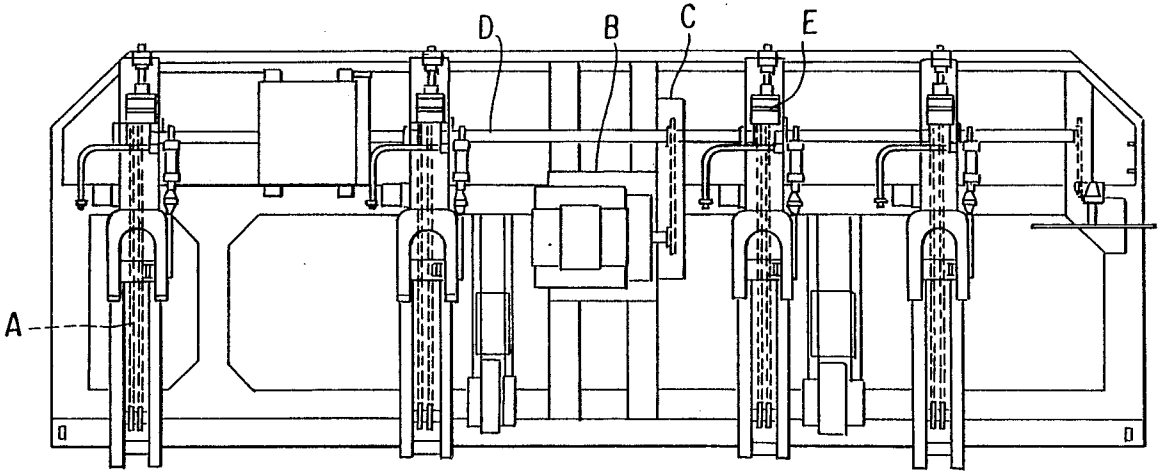
FIG. 2A is the same view as FIG. 2, but of a typical prior art carriage.
Figure 3:
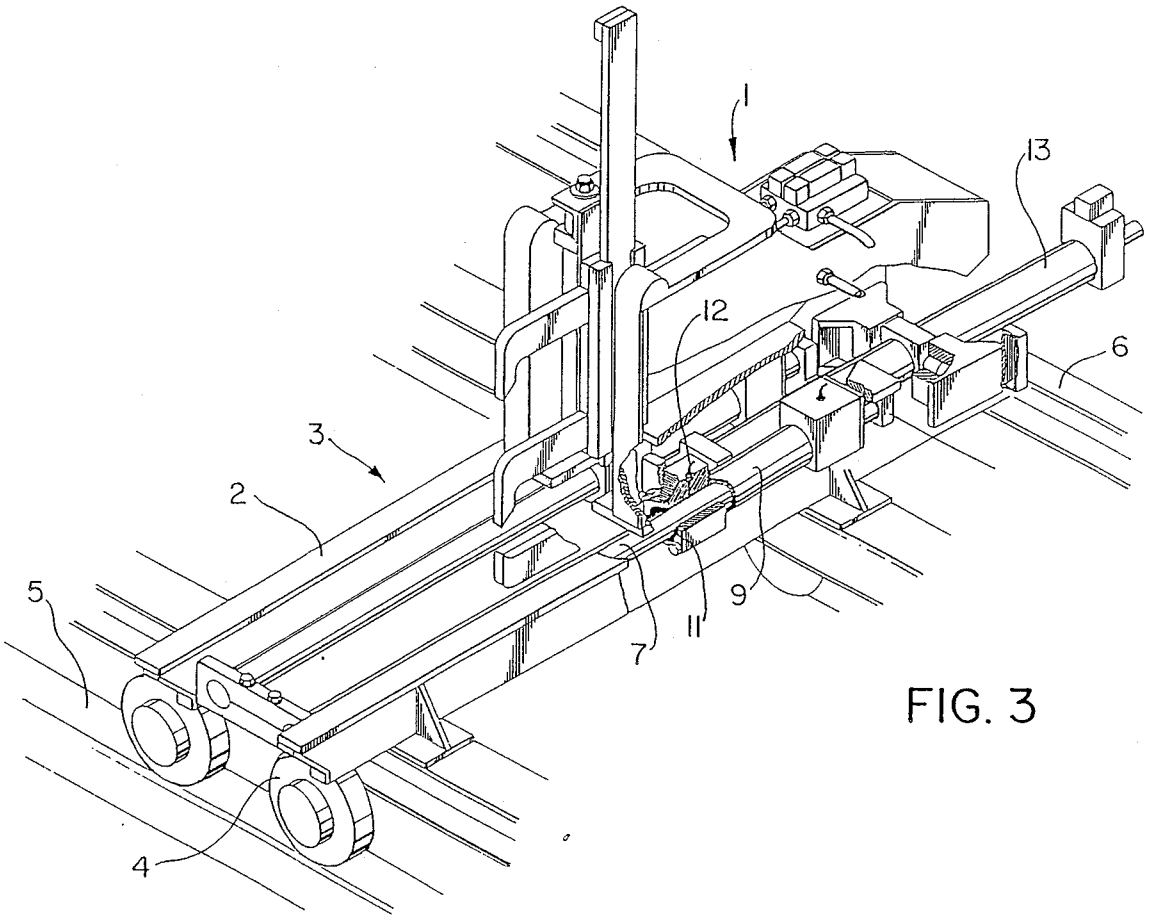
FIG. 3 is a perspective view, partially cut away of a knee resting on a bunk, supported by the shafts of the present invention and movable by the cylinders of the present invention.

Next, reference is made to FIGS. 2, 2A and 3, wherein the present invention is illustrated, and contrasted with the prior art. It will be appreciated that there are two aspects to the present invention (which aspects are very closely related) as follows:

(i) shafts or slides, which support the knee, and across which the knees move. The use of shafts (also called slides) lead to a beneficial stability of the knee (and hence, a log) on the bunk;

(ii) the combination of (i) and hydraulic cylinders, for moving the knees across the bunks. This permits fine calibration of motion, and keeps the number of moving parts down. Also, synchronization of the movement of the knees is enhanced. This combination is advantageous, as the stability of which a log will be held, made possible by the present invention's use of slides is best taken advantage of when hydraulic cylinders, which can very accurately position a log, are used.

Referring to FIG. 3 in the present invention, the knee, shown generally as 1, is mounted directly above the lateral supporting surface 2 of a bunk, shown generally as 3. The bunk 3 is mounted, by means of wheels 4, on the rails 5 of a carriage, shown generally as 6.

A pair of spaced apart parallel cylindrical slides 7 span the width of the bunk 3, and are firmly connected to the ends thereof. Preferably, the slides are chrome-plated steel, and in a typical example will have a diameter (outside) of 4½ inches. It will be noted that the slides 7 are located beneath the upper surface 2 of the bunk 3, which surface supports logs to be cut.

The knee 1 is slidably mounted on the slides 7 by means of bushings 9 running between supports 10. At each end of each bushing 9, a deformable wiper seal 11 is provided, and a lubrication line 12 may also be provided, in order to keep the bushings well lubricated. A suitable bushing for the present application is a Glycador TM bushing.

Movement of the knee across the bunk is accomplished by means of a hydraulic cylinder 13, shown in FIG. 2 and FIG. 3 in the retracted position. Hydraulic lines 14 lead into the cylinder which, in a typical embodiment is provided with a 2 inch Atlas Manufacturing TM cylinder rod. The hydraulic lines 14 are connected to a source of hydraulic fluid under pressure (not illustrated), which can be located from a remote location. There is a servo valve between the lines 14 and the cylinder, in a preferred embodiment.

The hydraulic cylinder-powered knee of the preferred embodiment of the present invention can be contrasted with knee powering systems such as that exemplified in FIG. 2A, shown in shading. It will be seen from FIG. 2A that prior art knee powering systems typically included drive chains A, brakes, motors B (which, unlike a hydraulic source must be a part of the carriage assembly) reduction units C, line shaft D, bearings and sprockets E, and so on. This is not to say that such carriage systems have not been effective. They have been, but at high maintenance cost because they are quite complex. Moreover, a chain driven unit is not capable of the accuracy possible with the present invention, and therefore not inherently capable of exploiting the improved stability of the knees of the present invention.

It will be understood that variations of the present invention will be possible, and will occur to a person skilled in the art.

We claim:

1. In a sawmill carriage capable of reciprocating on rails towards and away from a saw, and provided with more than one bunk having an upper surface capable of supporting a log, and a knee mounted on each said bunk, capable of gripping a log and moving across said bunk in a direction normal to the direction of reciprocation of said carriage, the improvement comprising cylindrical slides securely attached to said bunk beneath said upper surface, parallel to the direction of travel of said knee for supporting said knee; and complimentary bushings securely attached to said knee and cooperating with said slides.

2. The improvement of claim 1, wherein said slides are chrome plated, and the complimentary bushings comprise a pair of bushings provided on said knee, there being a deformable seal associated with each end of each bushing, around a said slide to prevent foreign matter from entering the associated said bushing.

3. In a sawmill carriage capable of reciprocating on rails towards and away from a saw, and provided with more than one bunk having an upper surface capable of supporting a log, a frontward end, a rearward end, and a knee mounted on each said bunk, said sawmill carriage capable of gripping a log and moving across said bunk in a direction normal to the direction of reciprocation of said carriage the improvement comprising, in combination:

(i) a pair of cylindrical slides disposed beneath the upper surface of said bunks and securely attached to the ends of same;

(ii) bushings on said knees slidable on said cylindrical slides for supporting said knees, there being a deformable seal on each end of said bushing;

(iii) a hydraulically powered cylinder extending between and connected to each knee opposite where a said log is gripped and the adjacent end of the associated bunk; and (iv) a source of hydraulic fluid, connected to said hydraulically powered cylinder via hydraulic lines and a servo valve.

* * * * *